US006149265A

United States Patent [19]

Watanabe

[11] Patent Number: 6,149,265

[45] Date of Patent: Nov. 21, 2000

[54] RECORDING ELEMENT UNIT, INK JET RECORDING ELEMENT UNIT, INK JET CARTRIDGE AND INK JET RECORDING APPARATUS

[75] Inventor: Yasutomo Watanabe, Hiratsuka, Japan

[73] Assignee: Canon Kabushiki Kaisha, Tokyo, Japan

[21] Appl. No.: 09/098,424

[22] Filed: Jun. 17, 1998

[30] Foreign Application Priority Data

Jun. 20, 1997 [JP] Japan ..... 9-164500
Jun. 12, 1998 [JP] Japan ..... 10-165024

[51] Int. Cl.[7] ..... B41J 2/05
[52] U.S. Cl. ..... 347/58
[58] Field of Search ..... 347/58, 59, 62, 347/57, 61, 56

[56] References Cited

U.S. PATENT DOCUMENTS

| | | | |
|---|---|---|---|
| 4,887,099 | 12/1989 | Terai et al. | 346/140 R |
| 4,914,736 | 4/1990 | Matsuda | 347/43 |
| 5,204,689 | 4/1993 | Shirato et al. | 347/58 |
| 5,483,270 | 1/1996 | Watanabe | 347/56 |

FOREIGN PATENT DOCUMENTS

| | | |
|---|---|---|
| 0659563 | 6/1995 | European Pat. Off. . |
| 4223707 | 1/1993 | Germany . |

OTHER PUBLICATIONS

Patent Abstracts of Japan; vol. 11, No. 225 (M–609), Jul. 22, 1987 & JP 62 039253 A, Feb. 20, 1987.

Patent Abstracts of Japan; vol. 14, No. 132 (M–948), Mar. 13, 1990 & JP 02 000512 A, Jan. 5, 1990.

*Primary Examiner*—John Barlow
*Assistant Examiner*—Juanita Stephens
*Attorney, Agent, or Firm*—Fitzpatrick, Cella, Harper and Scinto

[57] ABSTRACT

It is intended to secure the space for the signal wirings in the manufacture of an ink jet recording element unit of a high density. In the manufacture of the ink jet recording element unit by providing, on a substrate, a plurality of recording elements each composed of an individual electrode, an electrothermal converting element, a common electrode and a return electrode, a notch portion is formed on the outer edge of the electrothermal converting member adjacent to the return electrode.

7 Claims, 7 Drawing Sheets

RECORDING ELEMENT UNIT, INK JET RECORDING ELEMENT UNIT, INK JET CARTRIDGE AND INK JET RECORDING APPARATUS

BACKGROUND OF THE INVENTION

1. Field of the Invention

The present invention relates to a recording element unit, an ink jet recording element unit, an ink jet cartridge and an ink jet recording apparatus for driving the heat generating resistance member by using an individual electrode and a common electrode.

2. Related Background Art

As the recording element unit for use in an ink jet recording apparatus, there is already known a configuration shown in FIGS. 10A to 10C, which are respectively a plan view of the recording element unit; a cross-sectional view along a line 10B—10B in FIG. 10A; and a partial magnified view of a portion 10C in FIG. 10A.

The recording element unit 30 is provided with a substrate 20, a heat generating resistance layer 1, individual electrodes (wirings) 2, an insulation layer 3, a protective layer 4, a common electrode (wiring) 5, electrothermal converting members (heat generating resistance members) 6, external connection electrodes 7, a return electrode (wiring) 8, and an external connection electrode 9. In general, the wirings are formed with a large width in order to reduce the wiring resistance, while the heat generating resistance members are formed with a narrow width in consideration of the resistance, the heat generating area, etc. As shown in FIG. 10C, the heat generating resistance member 6 is formed by providing the heat generating resistance layer 1 with notches 11, 12 in a substantially symmetrical manner, so that the center 15 of the individual electrode 2 substantially coincides with the center 16 of the electrothermal converting member 6.

The above-mentioned recording element unit 30 is normally provided with a plurality of the heat generating resistance members 6, the common electrodes 5, the individual electrodes 2, and the external connection electrodes 7, 9.

In the recording element unit 30, an electric current is supplied to the heat generating resistance member 6 formed in the heat generating resistance layer 1 to generate thermal energy in the heat generating resistance member 6.

More specifically, the thermal energy can be generated in the electrothermal converting member 6 by sequentially supplying the driving current through the external connection electrode 7, the individual electrode 2, the electrothermal conversion member 6, the common electrode 5, the return electrode 8 and the external connection electrode 9. The ink jet recording element unit is to execute recording, utilizing such thermal energy for ink discharging. The ink jet recording element unit having plural electrothermal converting members can be employed for realizing an ink jet recording apparatus capable of recording plural dots at the same time, thereby achieving high-speed recording.

Because of the recent demand for the recording of high density and high speed, it is already common to execute the recording of the main scanning line simultaneously. Also because of the increasing demand for recording image data in addition to the character data and recording in color, there is already proposed a recording element unit having a high density array of a multitude of electrothermal converting members.

However, in the manufacture of the recording element unit having a high-density array of the electrothermal converting members, such electrothermal converting members have to be arranged with a constant pitch. Also, the high-density arrangement of the electrothermal converting members leads to a high-density arrangement of the individual electrodes, so that there will be left no room for the return electrode between the individual electrodes. Stated differently, the formation of the wiring for the return electrode becomes extremely difficult.

SUMMARY OF THE INVENTION

In consideration of the foregoing, the object of the present invention is to provide a recording element unit, an ink jet recording element unit, an ink jet cartridge and an ink jet recording apparatus incorporating such ink jet recording element unit, enabling an ultra high-density array of the electrothermal converting members and secure formation of the return electrode.

The above-mentioned object can be attained, according to the present invention, by a recording element unit provided, on a substrate, with plural heat generating resistance members, an individual wiring connected to an end of each of the heat generating resistance members, a common wiring connected in common to the other end of each of the heat generating resistance members, and a return wiring connected to the common wiring and positioned along the individual wiring, wherein the center line of the heat generating resistance member positioned near the return wiring is shifted toward the return wiring with respect to the center line of the individual wiring connected to the heat generating resistance member.

The above-mentioned recording element unit is further featured by a fact that the amount of the shift is larger for the heat generating resistance member positioned closer to the return wiring.

The above-mentioned recording element unit is further featured by a fact that the return wiring is provided between the plural individual wirings.

The above-mentioned recording element unit is further featured by a fact that the return wiring may be provided outside the plural individual wirings and that there are provided, on the substrate, plural sets each of which is composed of the individual wiring, the common wiring and the return wiring.

There is also provided an ink jet recording element unit comprising any of the above-mentioned recording element units, liquid paths provided corresponding to the above-mentioned heat generating resistance members and ink discharge openings provided in the liquid paths.

There is also provided an ink jet cartridge comprising the above-mentioned ink jet recording element unit and an ink container containing ink to be supplied to the ink jet recording element unit.

There is also provided an ink jet recording apparatus comprising the above-mentioned ink jet recording element unit, and drive signal supply means for supplying the ink jet recording element unit with a drive signal.

The above-mentioned configurations allow to increase the density of arrangement of the heat generating resistance members without an increase in the wiring resistance resulting from the reduction in the width of the individual wirings.

DESCRIPTION OF THE PREFERRED EMBODIMENTS

Now the present invention will be clarified in detail by embodiments thereof, with reference to the attached drawings.

First Embodiment

Figure 1A:
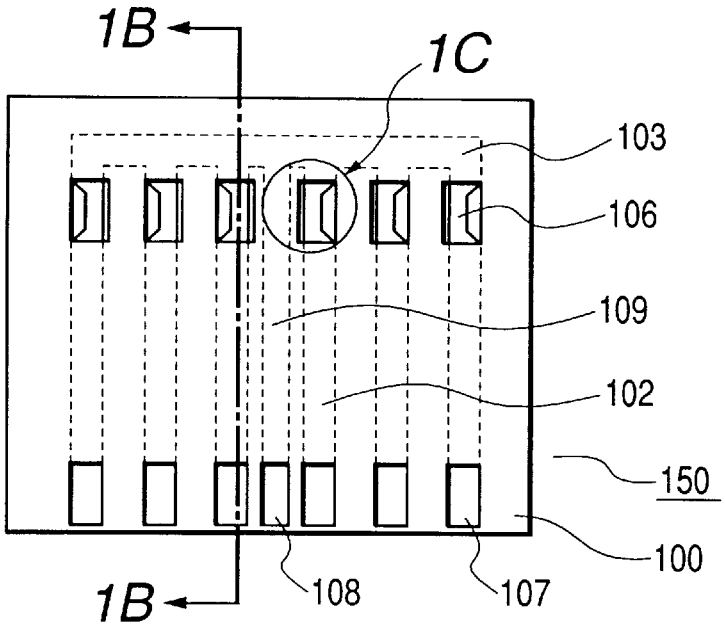
FIGS. 1A, 1B and 1C are schematic views of a recording element unit of the present invention and are respectively a plan view, a cross-sectional view along a line 1B—1B in FIG. 1A; and a magnified view of a portion 1C therein.
Figure 1B:
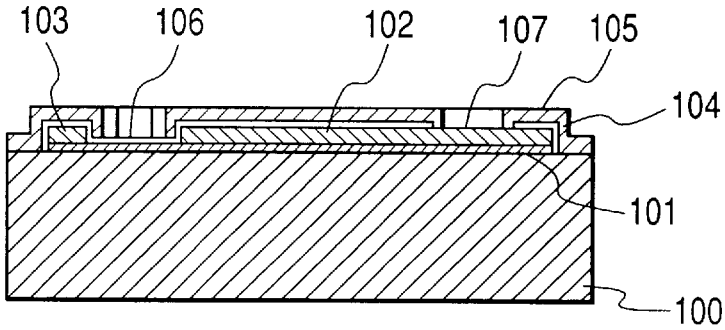

FIG. 1B illustrates a recording element unit 150, in which an insulating substrate 100 is composed for example of glass, ceramics or a surface-insulated conductive substrate such as silicon or a metal. On the substrate 100 there is formed a heat generating resistance layer 101, which is preferably obtained by vacuum film formation but may also be formed by any other methods such as thick film printing. The heat generating resistance layer is preferably formed with a material showing satisfactory heat proof and allowing uniform film formation, such as AlN, TiN or Ta.

A part of the heat generating resistance layer 101 constitutes an electrothermal converting member (heat generating resistance member) 106, and, on the heat generating resistance layer 101, there are laminated an individual electrode (individual wiring) 102 and a common electrode (common wiring) 103. The individual electrode is connected to an end of each electrothermal converting member, and the common electrode is connected to the other end. These electrodes are preferably formed with a metal of high conductivity, such as Al, Cu, Au or Ag.

An oxide film 104 of high corrosion resistance (proof), high oxidation resistance (proof) and high cavitation resistance (proof) is provided for protecting the heat generating resistance layer 101, the individual electrode 102 and the common electrode 103. The oxide film 104 is preferably formed by oxidizing the surface of the electrodes 102, 103.

On these components, there is formed an organic protective film 105, which is formed over the entire surface of the substrate 100, except for the electrothermal converting members (heat generating resistance members) 106 and external connection electrodes 107, 108 to be explained later. The protective film 105 is preferably composed of a material with satisfactory heat proof and moisture resistance (proof), such as polyetheramide or polyimide.

FIG. 1A is a plan view of the recording element unit 150, in which the common electrode is connected to a return electrode (wiring) 109 and thereby connected to the above-mentioned external connection electrode 108. The return electrode is provided along each individual electrode and is preferably formed with a metal of high conductivity such as Al, Cu, Au or Ag.

Figure 1C:
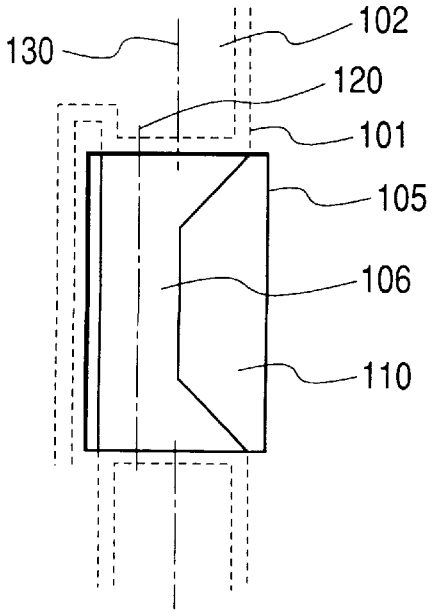

FIG. 1C is a partial magnified view of a portion 1C of the recording element unit 150 shown in FIG. 1A. The electrothermal converting member 106 is formed by reducing the width of the heat generating resistance layer 101 by forming, at an edge thereof, a substantially trapezoidal notch portion 110. The electrical resistance of the electrothermal converting member 106 is thus increased whereby heat is generated in such portion. As shown in FIG. 1C, the notched portion 110 is formed asymmetrically only at an edge wherein the center line (axis) 120 of the electrothermal converting member 106 is shifted with respect to the center line (axis) 130 of the individual electrode 102 toward the return electrode. Thus, as shown in FIG. 1C, taking the return electrode 109 as the axis of symmetry (central axis), the electrothermal converting member 106 at the right-hand side is so formed that the heat generating resistance member 101 is shifted to the side of the return electrode 109.

Similarly, in the electrothermal converting member at the other left-hand side of the return electrode taken as the axis of symmetry (central axis), the notch portion is formed on an outside edge (left-hand edge in the drawing) with respect to the axis of symmetry composed of the return electrode 109, whereby the heat generating resistance member is shifted toward the return electrode.

In the present invention, the center of the electrothermal converting member is shifted toward the return electrode as explained above, whereby, even in case the return electrode is positioned between the electrothermal converting members, it is rendered possible to position the electothermal converting members, the return electrode and the individual electrodes so as to maintain the constant pitch of the electrothermal converting members without reducing the width of the return electrode and of the individual electrodes.

In the following there will be given a more specific numerical example.

As an example, in case of forming a recording element unit employing the heat generating resistance members of a width of 20 $\mu$m and the individual electrodes of a width of 30 $\mu$m, with a density of 600 dpi or a pitch of 42.5 $\mu$m, the space between the individual electrodes becomes 12.5 $\mu$m in the conventional configuration and it is difficult to form the return electrode in such gap.

On the other hand, in the above-explained configuration in which the heat generating resistance member is shifted, a space of 22.5 $\mu$m is secured in the portion where the return electrode is to be formed. Consequently the return electrode can be formed without reducing the width of the electrode.

In the present invention, the effect of securing the space for the return electrode becomes greater as the density of the recording element unit becomes higher.

In the foregoing description the notch portion 110 is formed only on the outside edge (farther from the return electrode) of the heat generating resistance member, but such configuration is not restrictive and the notch portion may be provided on both sides of the heat generating resistance member. In such case the notch portion is made larger (deeper) on the outside edge of the heat generating resistance member than on the inside edge. Also in the foregoing description it is assumed that all the heat generating resistance members have an identical shape, including the shape of the notch portion 110. Also, in the present invention, the recording element is preferably composed of an electrothermal converting member for generating thermal energy, but such configuration is not restrictive.

A recording element unit shown in FIGS. 1A to 1C was prepared in the following manner.

On a glass substrate, a film of TaAl is formed with a thickness of 3000 Å by sputtering. Then TaAl was patterned by a photolithographic process. At first positive photoresist (OFPR800 manufactured by Tokyo Ohka Co.) was roller coated on TaAl by roll coating method. Spin coating method may also be similarly employed. Thus formed photoresist layer is prebaked for 30 minutes at 90° C., and was exposed to the pattern of the individual electrodes, the heat generating resistance members etc.

Then dry etching is executed employing the patterned photoresist as the mask, and $BCl_3$ and $Cl_2$ are ised as the etching gas. Thereafter, the photoresist is peeled with an exclusive stripping liquid.

Then an Al film is formed with a thickness of 1 $\mu$m by sputtering. As this Al film is to form the conductive electrodes, it is preferably made as thick as possible within the permissible range of the manufacturing process.

Thus formed Al film has been patterned by a photolithographic process. This pattern is formed on the previously formed TaAl pattern, but not on the portions constituting the heat generating resistance members.

Then the surface of the heat generating resistance members and the electrodes, excluding the external connection electrodes, is subjected to anodic oxidation to form a protective oxide film 104 on such surface, in order to improve oxidation resistance, corrosion resistance and cavitation resistance. The anodic oxidation is conducted in a mixture of ammonium tartarate, ethylene glycol and water, by the application of a voltage, utilizing the above-mentioned pattern as the anode.

Also in order to further improve the corrosion resistance, an organic protective film 105 of polyether amide was formed on the entire surface of the above-mentioned pattern, excluding the electrothermal converting members and the external connection terminals 107, 108, whereby the recording element unit of the present invention was completed.

Second Embodiment

In the foregoing embodiment, the amount of shift of the center of the electrothermal converting member from the center of the individual electrode is same in all the electrothermal converting members. But, further, if the density of arrangement of the individual electrodes of thereof is excessively high, the arrangement of the individual may be difficult. In the present embodiment, the amount of shift of the center of the electrothermal converting member with respect to the center of the individual electrode is made larger at the electrothermal converting member closer to the return electrode.

Figure 2:
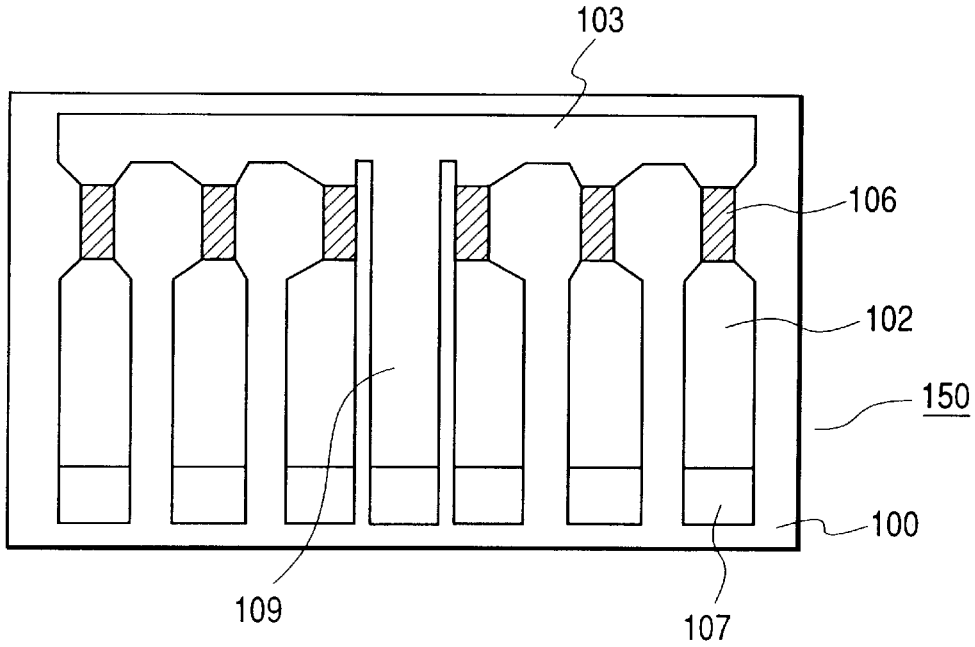
FIGS. 2 and 3 are plan views showing other recording element units of the present invention.

FIG. 2 shows such example, wherein the symbols indicate same components as in the foregoing embodiment. The return electrode 109 is taken as the center, and the electrothermal converting member 106, as it is closer to the return electrode, is shifted larger from the center 102 of the individual electrode toward the return electrode. Even when the return electrode 109 is positioned between the electrothermal converting members 106, it is rendered possible to arrange the electrothermal converting members 106 with a smaller pitch than that of the individual electrodes, without disturbing the pitch of the arrangement of the electrothermal converting members. Stated differently, despite of the presence of the return electrode, the electrothermal converting members can be arranged at a high density without reducing the width of the individual electrodes. Also the manufacture of the electrothermal converting members can be facilitated.

Third Embodiment

In the foregoing embodiments, the return electrode is positioned between the plural electrothermal converting members. In the present embodiment there will be explained a configuration in which the return electrode is positioned outside the arrangement area of the plural electrothermal converting members and a plurality of sets of plural electrothermal converting members, corresponding individual electrodes, a common electrode and a return electrode are provided on the substrate.

Figure 3:
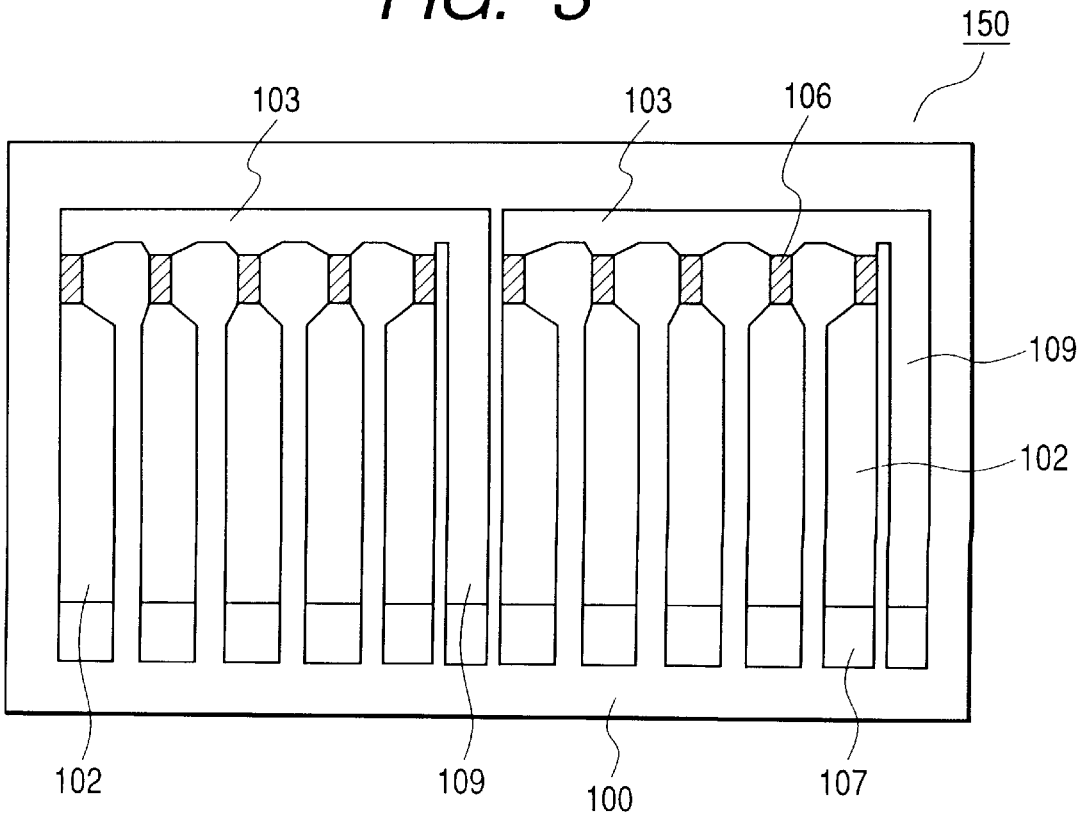

FIG. 3 shows such configuration, in which, on a substrate 100, there are provided two sets each of which is composed of five electrothermal converting members, individual electrodes 102 respectively connected to the five electrothermal converting members, and a return electrode connected in common to the five electrothermal converting members and positioned outside the arrangement area of the electrothermal converting members.

In this configuration, the two electrothermal converting members adjacent to the return electrode 109 belong to different sets, but each electrothermal converting member is shifted toward a closest return electrode regardless of the set.

Such configuration allows, even when the return electrode is positioned between the electrothermal converting members, to increase the density of arrangement of the electrothermal converting members while securing the position for providing the respective electrodes.

Fourth Embodiment

Figure 4:
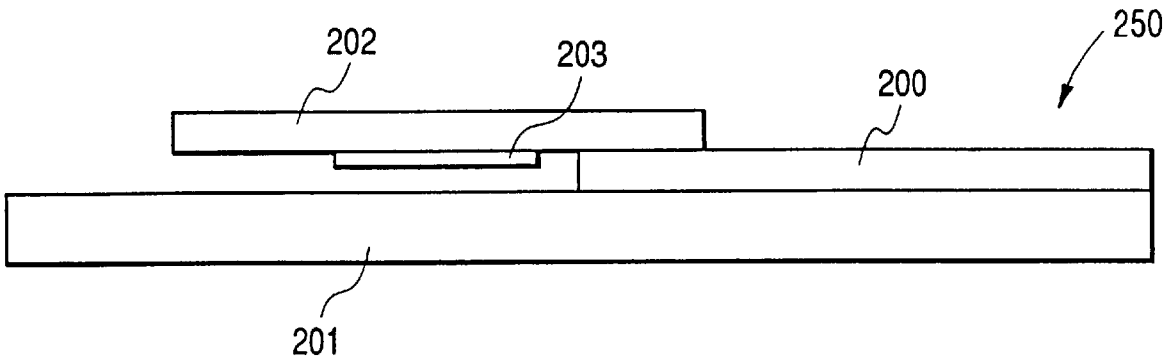
FIG. 4 is a schematic view showing the configuration of an example of the recording unit of the present invention.

FIG. 4 illustrates a recording unit 250 which is formed by mounting, on a support member 201, a recording element unit 200 prepared by the present embodiment, a recording element unit driving board 202 for driving the recording element unit 200, and a driving IC 203. The recording unit 250 is provided with the liquid paths, ink discharge openings etc. and can be utilized, in addition to the ink jet recording, in various applications such as a thermal head.

The ink jet recording element unit of the present invention can be formed by providing the above-mentioned recording element unit with discharge openings for ink discharge, liquid paths communicating therewith etc. Also the ink jet unit can be formed by mounting a recording element driving board to the above-mentioned ink jet recording element unit.

Fifth Embodiment

Figure 5:
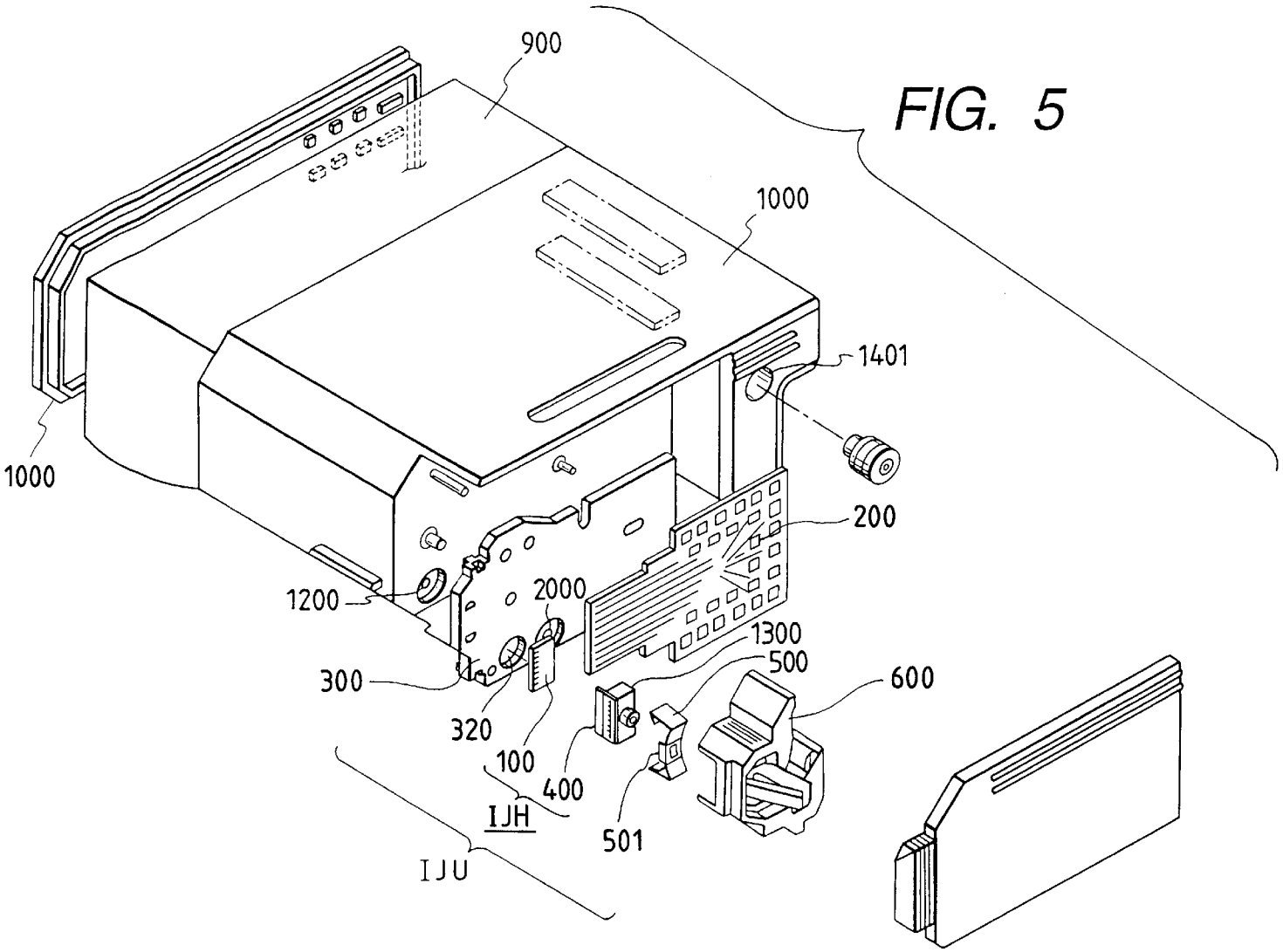
FIGS. 5 and 6 are views showing an ink jet cartridge of the present invention.
Figure 6:
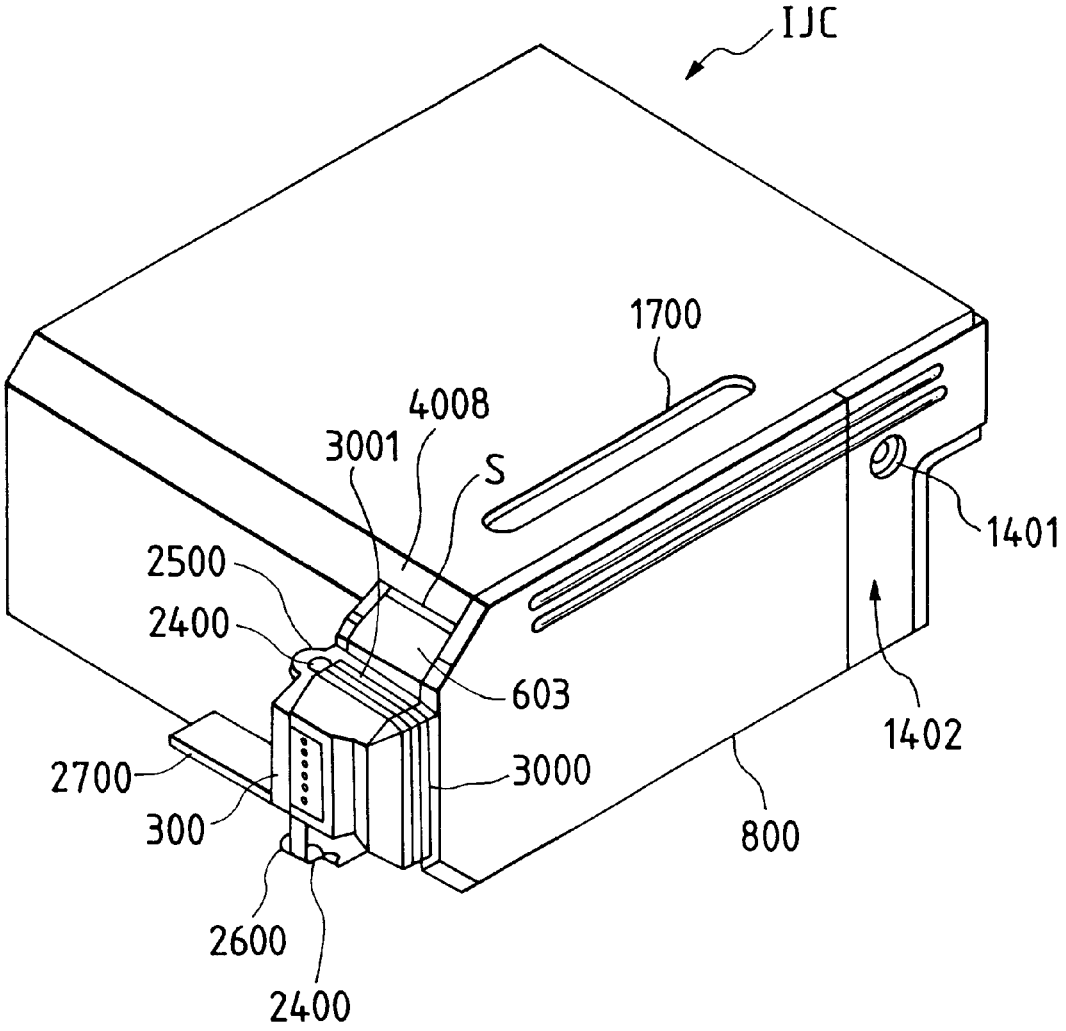

FIGS. 5 and 6 are schematic views of an ink jet recording element unit IJU and an ink jet cartridge IJC in which the present invention can be exploited or applied. In the following the various components will be explained with reference to these drawings.

The ink jet cartridge IJC of the present embodiment is composed, as shown in a perspective view in FIG. 6, of an integrated structure of an ink jet head unit and an ink tank with an increased proportion of the contained ink. The ink jet cartridge IJC is fixed and supported by positioning means and electrical contacts of a carriage provided in the main body of an ink jet recording apparatus and is constructed as disposable type, detachable from the carriage.

The ink jet recording element unit IJU is of bubble jet method, executing the recording operation with the electrothermal converting members which generate thermal energy in response to electrical signals for causing a film boiling phenomenon in the ink.

Referring to FIG. 5, a heater board (first substrate) 100 is provided, on a Si substrate, with an array of plural electrothermal converting members (discharge heaters) and electrical wirings composed for example of Al for electric power supply thereto, both being formed by a film forming technology. Also there is provided a wiring board 200 for the heater board 100.

A grooved cover plate 1300 is provided with partitions (grooves) for separating the plural ink paths and a common liquid chamber for containing ink for ink supply to the ink paths (liquid paths) and is integrally molded with an orifice plate 1400 provided with plural discharge openings corresponding to the ink paths. The material for such integral molding is preferably polysulfone resin, but other molding resinous material can also be employed.

A support member 300 composed for example of a metal and serving to support in flat form the bottom face of the wiring board 200 and constitutes the bottom plate of the ink jet unit. A pressing spring 500, constituting a pressing member, has an M-shape and is adapted to press the common liquid chamber with a light pressure by the central portion of the M-shaped structure and to linearly press a part of the liquid paths, preferably an area in the vicinity of the discharge openings by a front hanging portion 501. The heater board 100 and the cover plate 1300 are pressed and fixed by passing the legs of the pressing spring through holes 3121 of the support member 300 and causing the legs to engage with the rear face of the support member 300, whereby the heater board 100 and the cover plate 1300 are engaged in the pinched state.

The ink tank is composed of a cartridge main body 1000, an ink absorbent member 900, and a cover member 1100 which seals the main body 1000 after the ink absorbent member 900 is inserted thereinto from a side opposite to the mounting face of the unit IJU. There are further provided a supply opening 1200 for ink supply to the unit IJU, and an exterior communicating opening 1401 provided in the cover member for communication of the interior of the cartridge with the external air.

In the present embodiment, the cover plate 1300 is composed of a resinous material of satisfactory ink resistance such as polysulfone, polyethersulfone, polyphenylene oxide or polypropylene and is integrally molded, in a metal mold, with the orifice plate 400.

As explained in the foregoing, the integral molding applied to the ink supply member 600, the integral cover plate-orifice plate and the ink tank main body is effective for significantly improving the precision of assembly and for improving the quality in the mass production. Also as the number of components is reduced in comparison with that in the prior technology, the excellent characteristics can be securely achieved.

Sixth Embodiment

Figure 7:
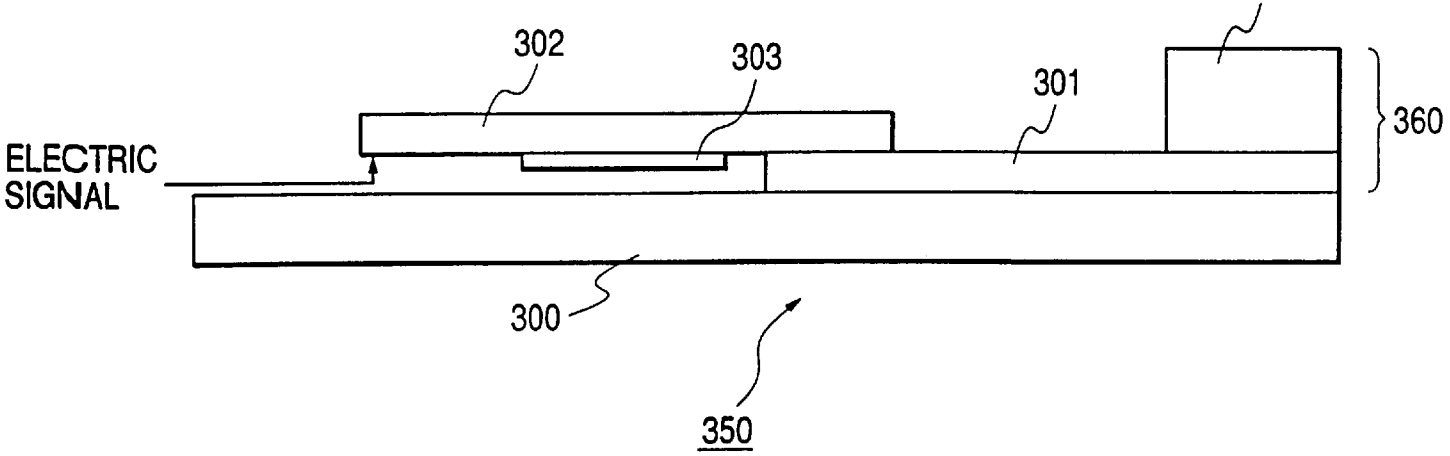
FIG. 7 is a schematic view showing the configuration of an example of the ink jet unit of the present invention.

An ink jet unit 350 shown in FIG. 7 was prepared. The unit 350 is formed by mounting, on the support member 300, an ink jet recording element unit 360, a recording element driving board 302 and a driving IC 303. The ink jet recording element unit 360 is composed of a recording element unit 301, and a liquid path unit 304 assembled thereon and composed of inks paths, discharge openings etc.

Figure 8:
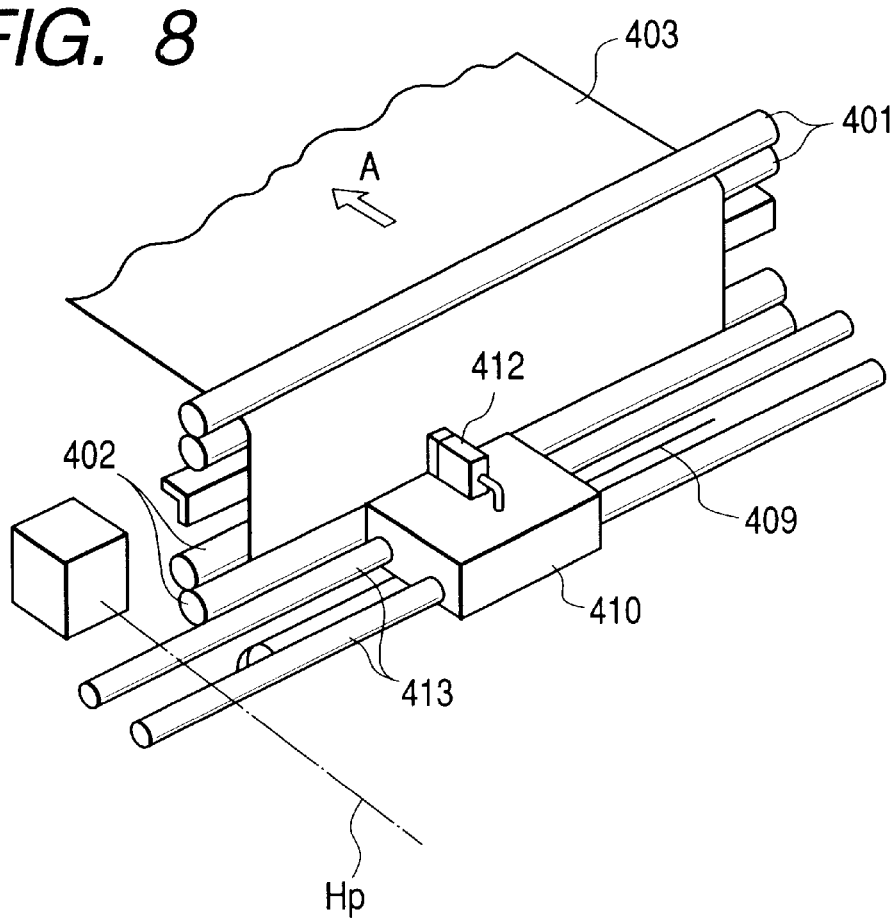
FIG. 8 is a schematic perspective view showing an example of the ink jet recording apparatus of the present invention.

Then an ink jet recording apparatus shown in FIG. 8 is prepared with the above-mentioned ink jet unit.

Referring to FIG. 8, a recording sheet 403 is transported by a sheet feed roller 402 to a sheet transport roller 401 provided above and is further transported in a direction indicated by an arrow A in FIG. 8. In front of the recording sheet 403 there is provided a carriage 410 which moves along a guide shaft 413. The carriage 410 supports thereon the ink jet unit explained in the foregoing. The carriage 410 is reciprocated by a carriage driving motor (not shown) through a belt transmission mechanism 409.

At the recording operation, based on the drive signals supplied to the ink jet unit 412 from signal supply means provided in the main body of the apparatus, the discharge openings (not shown) of the ink jet unit 412 discharge ink droplets toward the recording sheet 403 thereby obtaining the recording.

The ink jet unit 412 is provided with the discharge openings directed toward the recording sheet, and is adapted to discharge ink droplets from the discharge openings, in response to the signals from the driving IC.

Figure 9:
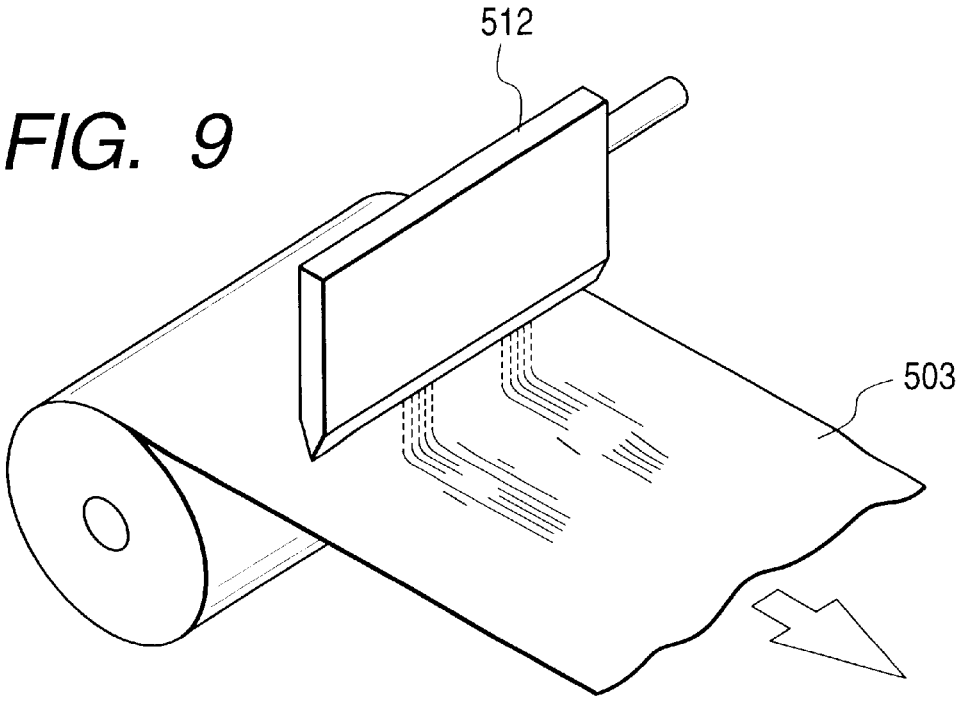
FIG. 9 is a schematic perspective view showing another example of the ink jet recording apparatus of the present invention.
Figure 10A:
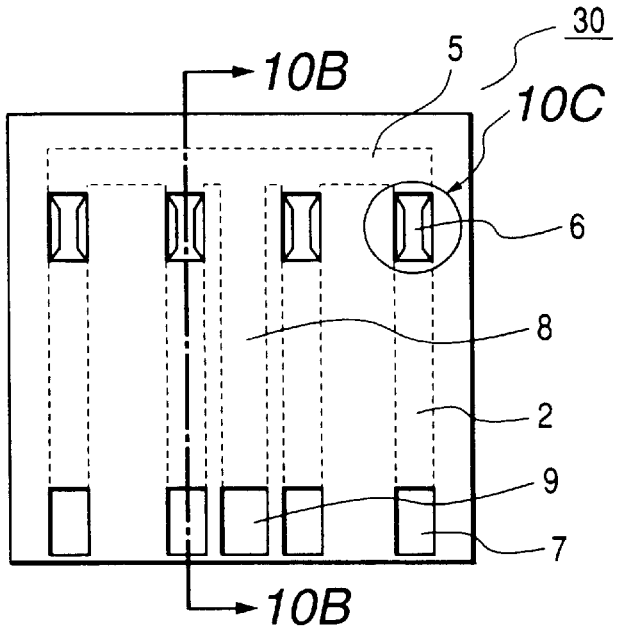
FIG. 10A PRIOR ART
FIGS. 10A, 10B and 10C are schematic views showing a conventional recording element unit and are respectively a plan view; a cross-sectional view along a line 10B—10B in FIG. 10A; and a magnified view of a portion 10C therein.
Figure 10B:
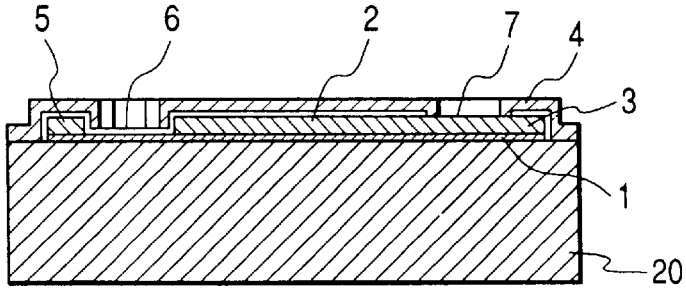
FIG. 10B PRIOR ART
Figure 10C:
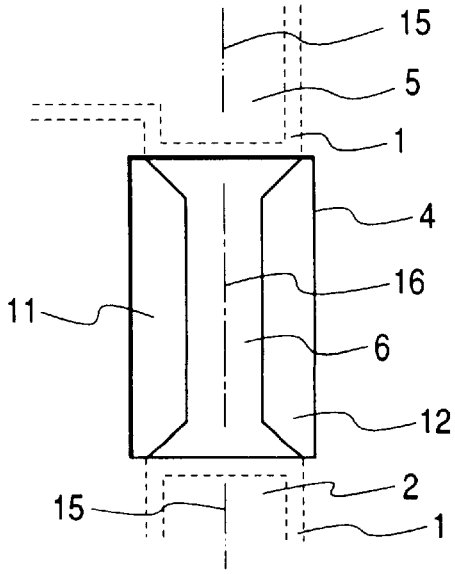
FIG. 10C PRIOR ART

FIG. 9 illustrates another embodiment of the ink jet recording apparatus, which is different from the apparatus of the foregoing embodiment in that the ink jet unit 512 employs an ink jet recording element unit of a width corresponding to the recording width of the recording sheet 503. In such configuration, as the carriage need not be reciprocated, the recording apparatus can be simplified in structure and the recording can be achieved with a higher speed.

The present invention allows to secure the space for forming the return electrode, even in case the wirings are provided at a higher density corresponding to the arrangement of the electrothermal converting members at a higher density. Consequently the present invention easily realizes the higher recording density required in the market, thereby contributing greatly to the higher definition and higher quality of the recorded image.

What is claimed is:

1. A recording element unit having a substrate, said substrate comprising:

plural heat generating resistance members having ends;

individual wirings each of which is connected to an end of a respective one said heat generating resistance members;

a common wiring connected in common to another end of each of said heat generating resistance members; and a return wiring connected to said common wiring and provided along said individual wirings, wherein a center line of at least one of said heat generating resistance members provided near said return wiring is shifted toward said return wiring, with respect to a center line of the individual wiring connected to said heat generating resistance member, and wherein the center lines of those ones of the heat generating resistance members which are located closer to said return wiring are shifted by greater amounts than center lines of heat generating resistance members which are not located as close to said return wirings.

2. A recording element unit according to claim 1, wherein said return wiring is provided between the plural individual wiring.

3. A recording element unit according to claim 1, wherein said return is provided outside of the plural individual wirings.

4. A recording element unit according to claim 1, wherein said substrate is provided with a plurality of sets, each set providing said plural heat generating resistance members, said individual wirings, said common wiring and said return wiring.

5. An ink jet recording element unit comprising:

a recording element unit according to any of claims 1 or 2 to 4, liquid paths provided corresponding to said heat generating resisting members, and discharge openings for discharging ink, provided in said liquid paths.

6. An ink jet cartridge comprising:

an ink jet recording element unit according to claim 5, and an ink container containing ink to be supplied to said ink jet recording element unit.

7. An ink jet recording apparatus comprising:

an ink jet recording element unit according to claim 5, and a drive signal supply device for supplying said ink jet recording element unit with a drive signal.

* * * * *

UNITED STATES PATENT AND TRADEMARK OFFICE

CERTIFICATE OF CORRECTION

PATENT NO. : 6,149,265
DATED : November 21, 2000
INVENTOR(S) : Yasutomo Watanabe It is certified that error appears in the above-identified patent and that said Letters Patent is hereby corrected as shown below:

Column 3,
Line 17, "invention;" should read -- invention; and --.

Column 5,
Line 10, "Spin" should read -- A spin --;
Line 16, "ised" shoud read -- used --;
Line 48, "of" (second occurrence) should be deleted;
Line 49, "individual" should read -- individual electrodes --;
Line 53, "member" should read -- member and --; and
Line 57, "same" should read -- the same --.

Column 7,
Line 58, "inks" shoudlr ead -- ink --.

Column 8,
Line 35, "one" should read -- one of --;
Line 54, "wiring." should read -- wirings. --;
Line 56, "return" should read -- return wiring --;
Line 64, "claims 1 or" should read -- claims 1 to 4, --; and
Line 65, "2 to 4," should be deleted.

Signed and Sealed this

Eighth Day of January, 2002

*Attest:*

*Attesting Officer*

JAMES E. ROGAN
*Director of the United States Patent and Trademark Office*